US005275286A

United States Patent [19]

Bader

[11] Patent Number: 5,275,286

[45] Date of Patent: Jan. 4, 1994

[54] PHOTO DISPLAY PACKAGE

[76] Inventor: Robert Bader, 2 Junewood Crescent, Willowdale, Ontario, Canada, M2L 2C4

[21] Appl. No.: 984,615

[22] Filed: Dec. 2, 1992

[30] Foreign Application Priority Data

Oct. 15, 1992 [CA] Canada ..... 2080603

[51] Int. Cl.[5] ..... B65D 85/62; B65B 15/00

[52] U.S. Cl. ..... 206/455; 53/475; 229/72

[58] Field of Search ..... 40/124, 124.2, 124.4, 40/158.1, 159; 53/415, 455, 460, 473, 475; 206/232, 449, 450, 455, 456, 460, 472; 229/72

[56] References Cited

U.S. PATENT DOCUMENTS

| | | | |
|---|---|---|---|
| 2,280,889 | 4/1942 | Buxton | 229/72 |
| 2,952,879 | 11/1960 | Mazur | 40/124.4 |
| 3,299,928 | 1/1967 | Inkley | 229/72 |
| 3,503,835 | 3/1970 | Hermann . | |
| 3,620,891 | 11/1971 | Jones et al. . | |
| 3,847,195 | 11/1974 | Tyrseck | 229/72 |
| 3,847,325 | 11/1974 | Nasalski et al. . | |
| 3,850,083 | 11/1974 | Falcon | 229/72 |
| 3,858,790 | 1/1975 | Humphrey | 229/72 |
| 3,885,768 | 5/1975 | Frye . | |
| 3,939,588 | 2/1976 | Hockaday . | |
| 4,047,661 | 9/1977 | Klein | 229/72 |
| 4,106,230 | 8/1978 | Martinez . | |
| 4,253,258 | 3/1981 | Harold . | |
| 4,263,735 | 4/1981 | Miller et al. | 40/159 |
| 4,400,899 | 8/1983 | Martinez . | |
| 4,531,320 | 7/1985 | James . | |

OTHER PUBLICATIONS

Photographs of a package identified as "Photopac " and Cardpac.

*Primary Examiner*—Jimmy G. Foster
*Attorney, Agent, or Firm*—Bereskin & Parr

[57] ABSTRACT

A package is provided for sorting photo prints and films and for assembling and displaying the prints. The package has a cover with an inside face, a top edge, a bottom edge, and first and second side edges. The cover may be opened and closed about a center spine which extends between the top and bottom edges of the cover and divides the inside face into first and second portions. A pocket for storing the prints and film overlies each of the first and second portions. A generally rectangular pad is connected along one of its edges adjacent the top edge of one of the first or second portions. Prints may be assembled on the pad in an overlapping, staggered relationship for display when the cover is open. The pad has a generally flexible substrate, an adhesive coating on one side of the substrate, and a plurality of removable ribbons covering the adhesive. The ribbons are removable from the substrate to uncover at least some of the adhesive coating for attaching the print to the cover by pressing an edge of the print against the uncovered adhesive coating.

22 Claims, 4 Drawing Sheets

PHOTO DISPLAY PACKAGE

FIELD OF THE INVENTION

This invention relates to a package for photo prints and film.

BACKGROUND OF THE INVENTION

Prints and negatives developed from a roll of film at a photo processing outlet, are usually returned in a protective package. The prints are usually loosely stacked one atop another and the negatives are inserted in flexible plastic casings. One type of package resembles a plain letter envelope with a flap at one end wherein the prints and the negatives are simply deposited inside. Another conventional package has a large flap which opens to reveal two pouches along one side, one for storing the prints and the other for storing the negatives. In either case, the prints must be removed from the package and sorted through to be viewed.

In order to protectively store the prints in an orderly manner for display, the prints must be transferred from the package to a separate photo album. This extra transfer step is inconvenient and time consuming, and a needless extra expense is incurred to purchase the album above the cost of processing the film. In addition, transferring the prints to an album usually results in the separation of the prints from the negatives, thereby causing both to be stored separately. After several films are developed, it becomes inconvenient, if not impossible, to later locate those negatives corresponding to a print of which extra copies are desired.

What is desired therefore is a photo display package to overcome the problems of these prior art packages. Preferably, the photo display package should provide storage for both prints and negatives after they are developed, and should provide a quick and efficient method of protectively storing the prints in an orderly manner for display.

SUMMARY OF THE INVENTION

According to the present invention, there is provided a package for photo prints and film comprising a cover with an inside face, said cover having:

(i) a top edge;
(ii) a bottom edge;
(iii) first and second side edges;
(iv) a center spine extending between said top and bottom edge of said cover and dividing said inside face into first and second portions, said cover being foldable about said spine between an open configuration where said first and second portions are splayed apart and a closed configuration where said first and second portions are brought into a facing, overlying relationship;
(v) first and second pockets overlying said first and second inside face portions, respectively, for storing said prints and film; and
(vi) a means for assembling said prints in an overlapping, staggered relationship and for displaying same when said cover is in the open configuration.

In another aspect of the invention, the invention provides a package for storing photo prints and films and for assembling and displaying the prints, said package comprising a cover with an inside face, said cover having:

(i) a top edge;

(ii) a bottom edge;
(iii) first and second side edges;
(iv) a center spine extending between said top and bottom edge of said cover and dividing said inside face into first and second portions, said cover being foldable about said spine between an open configuration where said first and second portions are splayed apart and a closed configuration where said first and second portions are brought into a facing, spaced relationship;
(v) a pocket overlying each of said first and second inside face portions, each of said pockets adapted for storing said prints and film;
(vi) a generally rectangular pad connected along an edge thereof adjacent the top edge of one of said first and second portions for assembling said prints in an overlapping, staggered relationship and for displaying same when said cover is in the open configuration, said pad having:
  (a) a generally flexible substrate;
  (b) an adhesive coating a first side of said substrate; and
  (c) a plurality of removable ribbons covering said adhesive to protect same;

wherein one of said ribbons is pulled off the substrate to uncover a respective zone of adhesive coated substrate for attaching said print to said cover by pressing an edge of said print against said uncovered adhesive coating.

DESCRIPTION OF THE DRAWINGS

Embodiments of the invention will now be described, by way of example only, with reference to the accompanying drawings, wherein.

DESCRIPTION OF PREFERRED EMBODIMENTS

Figure 1:
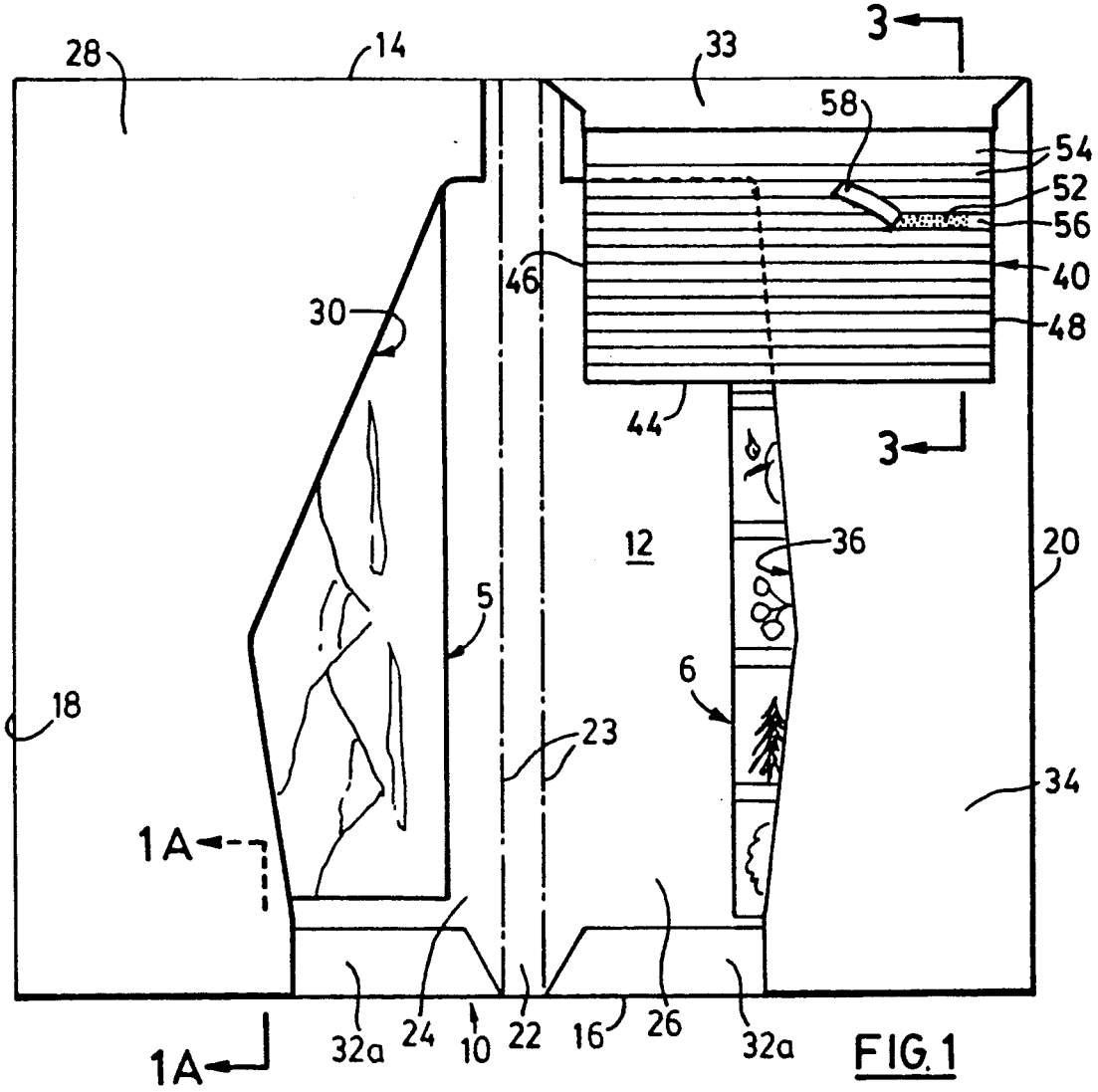
FIG. 1 is a plan view of the photo display package showing one embodiment of the present invention.

Reference is first made to FIG. 1 which shows an open photo display package 1 for storing photo positives or prints 5 and photo negatives or film 6 and for assembling and displaying the prints 5 as will be described below.

The package 1 has a generally planar cover 10, an inside face 12 and an outside face (not shown) opposite the inside face 12. The cover 10, made of cardboard or other like thin, stiff material, is rectangular in shape, having generally parallel top and bottom edges 14, 16 and generally parallel first, or left, and second, or right, side edges 18, 20. The cover 10 has a spine 22 located about mid-way between the left and right edges 18, 20 and extending between the top and bottom edges 14, 16, thus diving the inside face 12 of the cover 10 into first, or left, and second, or right, portions 24, 26. In the preferred embodiment, the spine 22 has two spaced apart, parallel fold lines 23 shown in dot-dash lines about which the left and right portions 24, 26 can be folded or closed to bring the portions into a facing, spaced relationship one on top of the other. FIG. 1 shows the cover 10 in an open configuration where the portions 24, 26 are splayed apart in a single plane.

Figure 1A:
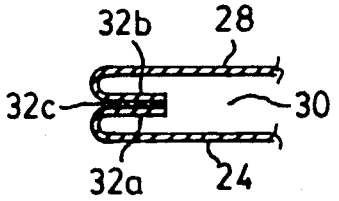
FIG. 1A is a partial cross-section of the package of FIG. 1 along the line 1A—1A.

Overlying the left portion 24 is a planar sheet 28 connected to the left portion 24 of the cover 10 adjacent the top and bottom edges 14, 16 and at the left side edge 18 to form a left pocket 30 for storing the prints 5 and/or the negatives 6. In the preferred embodiment, and as shown in greater detail in FIG. 1A, the left portion 24 has an upwardly and inwardly turned flap 32*a* and the sheet 28 has a corresponding downwardly and inwardly turned flap 32*b*. The flaps 32*a* and 32*b* are bonded together by glue 32*c* or other suitable means where they meet. Along the left side edge 18, the sheet 28 is preferably a folded over extension of (and integral with) the left portion 24 of the cover 10.

A similar arrangement is provided on the right side of the package 1 where a sheet 34 overlies the right portion 26 of the cover 10 to form another pocket 36 for storing the negatives 6 and/or the prints 5. It is preferred that the bottom flap 32*a* does not extend across the entire bottom edge 16 but is V-notched at the spine 22 (as shown) to avoid bursting or tearing of the spine 22 along its seams 23 when the cover 10 is repeatedly opened and closed.

Figure 3:
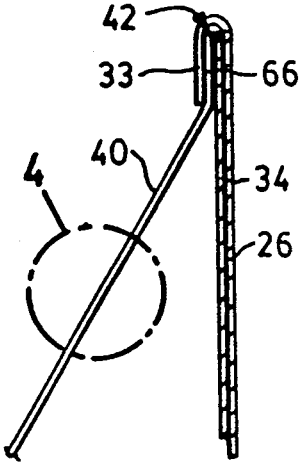
FIG. 3 is a partial cross-sectional view of the package and a pad thereon shown in FIG. 1 along the line 3—3.

In addition to the pocket 36, the right side of the cover 10 is further provided with a means for assembling and protectively storing the prints 5 in an overlapping, staggered relationship and for displaying the prints when the cover 10 is open. In the preferred embodiment, this assembly and display means is in the form of a generally rectangular pad 40. Referring to FIGS. 1 and 3, the pad 40 has a top end 42, a bottom end 44 and side edges 46, 48. The top end 42 is connected to the cover 10 adjacent its top edge 14 between a top flap 33, which preferably extends from the right portion 26, and the sheet 34. Suitable adhesive means is provided to bond the top end 42 of the pad 40 between the top flap 33 and the sheet 34 as will be described below with reference to FIG. 7.

It is noted that the flap 33 is notched on each side to match the width of the pad 40. The flap 33 acts as an alignment means to suitably align the pad 40 on the right portion 26 between the spine 22 and the right edge 20 prior to bonding. Alternately, the flap 33 may remain un-notched and suitable marks can be imprinted near the top edge 14 of the sheet 34 to align the pad 40 on the right portion 26 for bonding.

Figure 4:
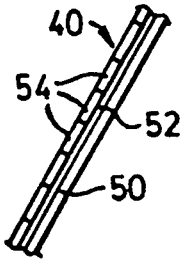
FIG. 4 is an enlarged view of the circled portion of the pad of FIG. 3.

As shown in FIGS. 1 and 4, the pad 40 has a substrate 50 coated with an adhesive 52 and covered with a flexible sheeting, or release paper, which has numerous removable or peelable and disposable ribbons or strips 54 of uniform width. Since the sheeting has been die-cut, the longitudinal edges of one ribbon abut the longitudinal edges of adjacent ribbons 54. The ribbons 54 protect the adhesive from dirt and other contaminants. When one of the ribbons 54 is pulled or peeled off the substrate 50, a respective zone or strip of adhesive 52 is uncovered (as shown in FIG. 1). One of the prints 5 may then be attached to the strip of uncovered adhesive by pressing an edge of the back of the print 5 against the uncovered adhesive.

Figure 5:
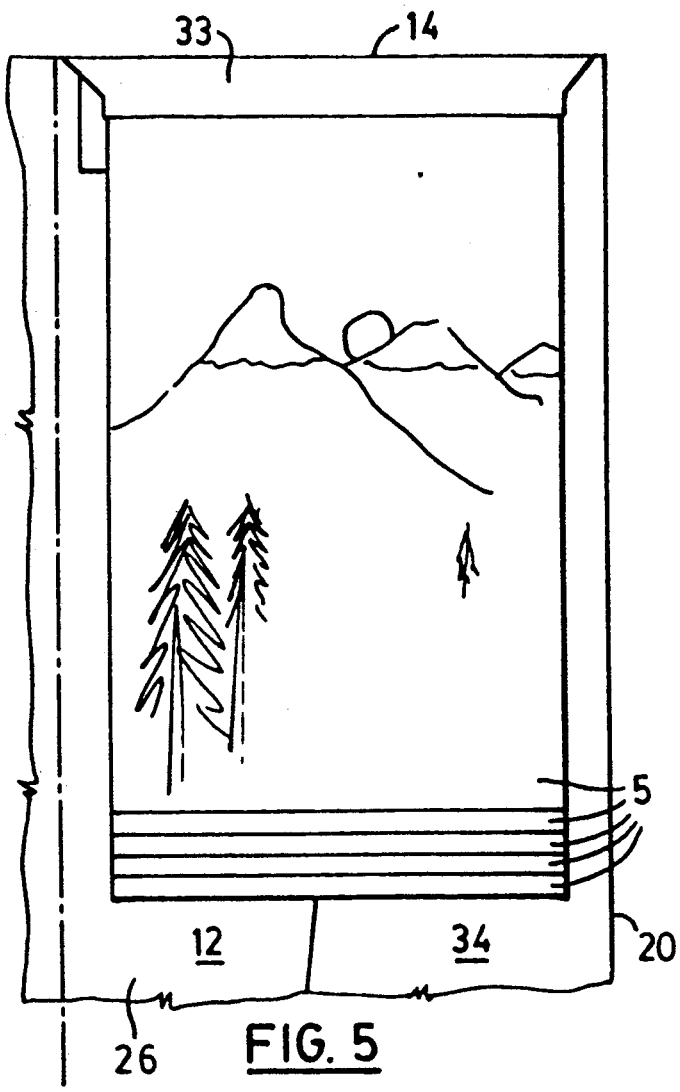
FIG. 5 is a partial plan view of the package of FIG. 1 showing some prints displayed on the pad.
Figure 6:
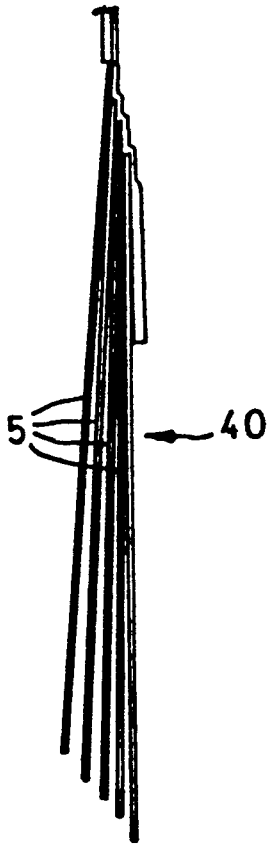
FIG. 6 is a side view of the prints and the pad of FIG. 5.

FIGS. 5 and 6 show several prints 5 which have been attached to the pad 40. It is preferable that the user start by peeling off the top ribbon 54 closest to the top edge 14, in this embodiment the ribbon 54 immediately adjacent the top flap 33. Then, the user can mount a first print onto the exposed adhesive. The bottom end of the first print is then lifted up and the longitudinal edge of the next adjacent ribbon is creased by the user to space or angle said adjacent ribbon from the back of the first print. The ribbon is then removed and a second print is mounted on the exposed adhesive. The user progresses in like manner down the pad 40 to stack or mount the prints 5 in an orderly, overlapping and staggered relationship. The first print mounted will therefore be at the top of the stack and wholly exposed for viewing whereas only a small bottom strip of each successive print 5 is seen when the package 1 is first opened. Hence, the next print 5 below the first print may be viewed by lifting the bottom end of the first print, and so on, allowing the user to readily flip through the stack of prints 5 on the pad 40. It will be appreciated that a user may also start by peeling off the bottom ribbon and work up the pad in reverse order.

In order for a print to be lifted as described above without detaching the print off the pad 40, the substrate 50 must be made of a flexible material to allow bending of the substrate 50 where the top edge of the print 5 meets the substrate 50. It will be apparent that the substrate 50 should also be resistant to tearing. Examples of materials which may be used for the substrate 50 are polypropylene or a non-woven material under the trade name TYVEK manufactured by E. I. Du Pont. A polyester film under the trade name MYLAR, manufactured by E. I. Du Pont may also be used because it is lightweight, flexible and inexpensive, although the side edges 46, 48 would have to be reinforced to enhance the MYLAR substrate's resistance to tearing. Such reinforcement could comprise providing a fold at each edge 46, 48 of the MYLAR substrate. Other woven substrates may be suitable as well.

Figure 2:
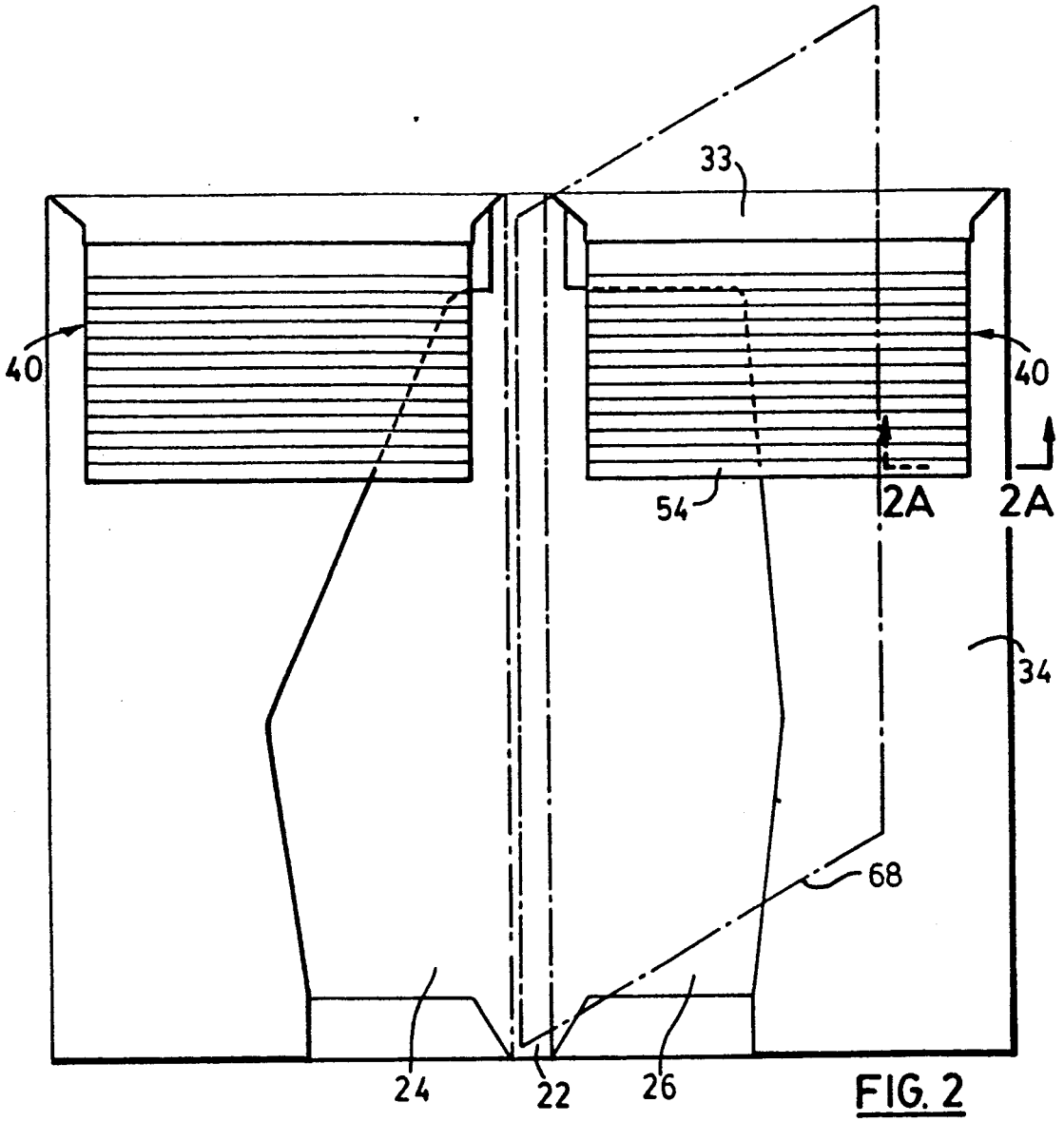
FIG. 2 is a plan view similar to that of FIG. 1 showing a second embodiment of the present invention.

To facilitate the peeling of the first ribbon 54 closest to the top flap 33 and to avoid the first print 54 from peeling off of the substrate 50, the first ribbon 54 is made wider than successive ribbons 54. In the preferred embodiment, the first ribbon is about 0.18 to 0.25 inches wide and all the other ribbons are about 0.125 inches wide each. It will be appreciated that the number of ribbons on each pad 40 (i.e.--the size of each pad) will depend on the number of prints 5 to be mounted. For example, in the FIG. 1 embodiment, the pad 40 will have 12 to 14 strips if the package 1 is designed to hold up to fourteen prints 5, and the respective negatives 6. In an alternate embodiment shown in the FIG. 2 where the package is to hold up to 28 prints, another pad 40 having fourteen ribbons 54 may be provided over the left portion 24 in like manner to the pad 40 in the preferred embodiment. It will be appreciated that the alternate embodiment may be further modified to store and display more prints 5, say up to thirty-six prints, by increasing the size of each pad 40 and the number of ribbons 54 thereon to eighteen.

Figure 2A:
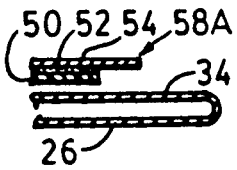
FIG. 2A is a partial cross-section of the package of FIG. 2 along the line 2A—2A.

To facilitate removal of the ribbons 54 off the pad 40, the adhesive 52 may be omitted along a region 56 of nominal width extending along each edge 46,48 of the substrate 50 (as shown in FIG. 1). Hence one or both ends of the ribbons 54 will not adhere to the substrate 50, thus forming tabs 58 which can be grasped by the user to peel the ribbon 54 off the pad 40. An alternate version of the tab is shown in FIG. 2A (indicated by the reference numeral 58A) wherein the ends of the ribbon 54 extend beyond the edges 46, 48 of the substrate 50.

Figure 7:
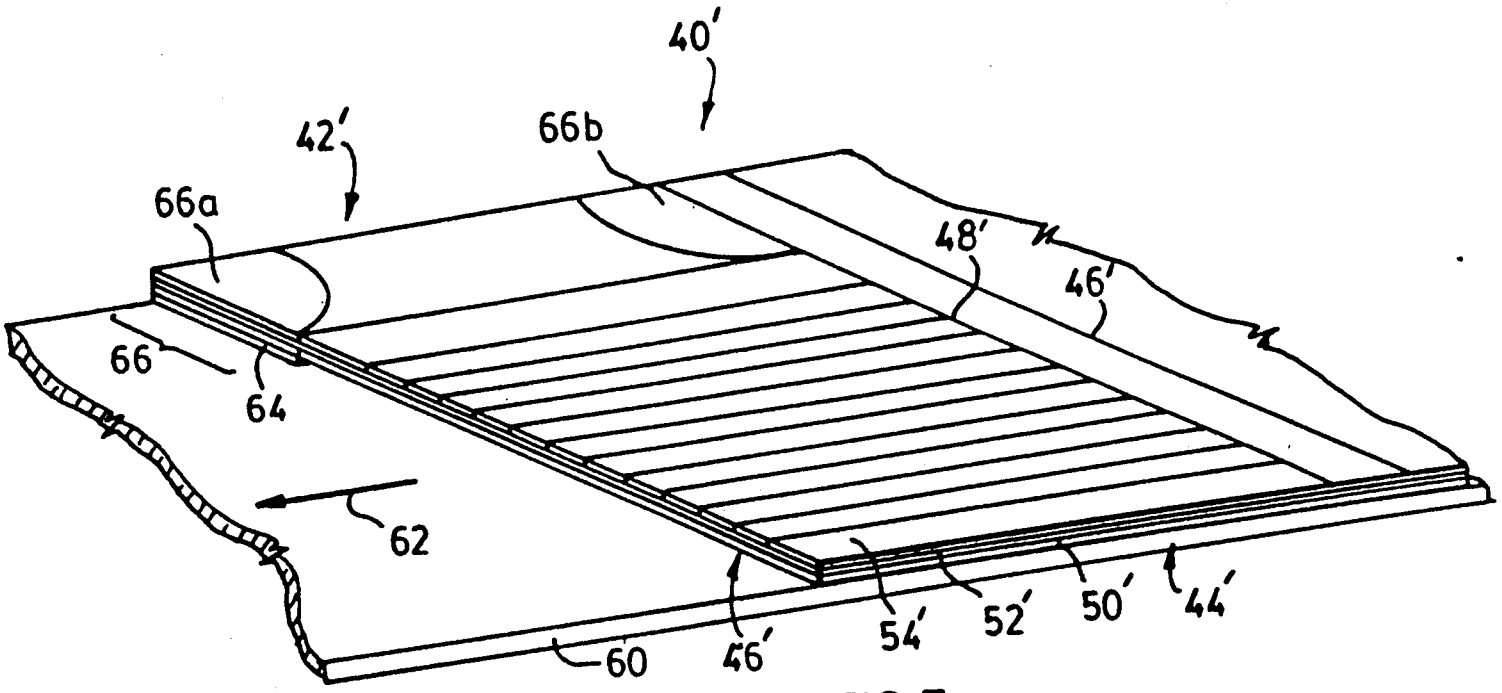
FIG. 7 is a perspective view of a process of producing the pad according to the present invention.

Referring now to FIG. 7, it illustrates a method of producing the pad 40' described above. Primed numerals are used to identify like elements from the preferred embodiment. For illustrative purposes only, the tabs 58 are omitted by continuing the adhesive 52' to the side edges 46', 48'. The substrate 50', the adhesive 52' and the sheet which is eventually cut into the ribbons 54' are layered onto a continuous strip of carrier paper 60 and formed into a large roll (not shown). The top and bottom edges of the carrier paper 60 correspond to the top and bottom ends 42', 44' of the pad 40'. The carrier paper 60 and the pad layers thereon are subsequently advanced off the roll (in the direction indicated by the arrow 62) and die-cut using circular dies, for example, to form the side edges 46', 48' of the pad 40' and the ribbons 54'.

The die cutting the side edge 46', 48' should pierce through the layers of the pad only, and not through the carrier paper 60. Likewise, the die cutting the ribbons 54' must not pierce the substrate 50 to avoid forming weakened planes along which the substrate 50 can easily tear. Once all cutting is completed, the pad 40' is mechanically lifted or scraped off the carrier paper 60 and mounted onto the package 1.

Each pad 40' has an upper strip 66 adapted to fit under the top flap 33 (as shown in FIG. 3); for example, the top flap 33 and the upper strip 66 may each be about 0.50 inches wide. To facilitate mounting of the pad 40' in the package 1 and to improve adhesion thereto, an extra layer of adhesive 64 is provided on the bottom surface of the substrate 50' extending along the upper strip 66 to bond the strip 66 to the sheet 34 adjacent the top edge of the package 1. The upper strip 66 is further modified by having portions **66*a*, 66*b*** removed therefrom (during the die-cutting process).

Figure 8:
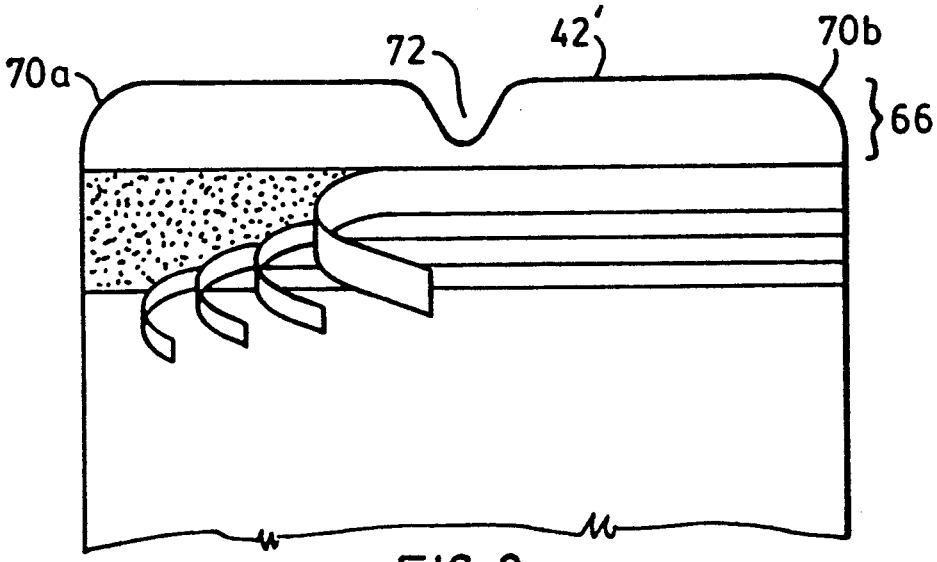
FIG. 8 is a plan view of the pad of FIG. 7 showing an alternate version thereof.

With the strip 66 in place on the sheet 34 as mentioned above, dabs of a suitable glue are deposited on the sheet 34 in the spaces created by the removed portions **66*a* and 66*b* and the top flap 33 is pressed over the strip 66, thereby bonding the pad 40' to the flap 33 and to the package 1. In an alternate embodiment, the portions 66*a*, 66*b* need not be cut out and instead a suitable adhesive is deposited along the top surface of the strip 66 to bond the flap 33 thereto. In a further alternate embodiment, the top layer of the strip 66 may be removed to expose a corresponding strip of adhesive 52' to which the flap 33 can bond. In a yet further embodiment, and as shown in FIG. 8, the upper strip 66 is modified by having rounded upper left and right corners 70*a* and 70*b*, respectively, and, in addition, one or more grooves 72 along the top end 42' intermediate the corners 70*a* and 70*b*. Dabs of a suitable glue are deposited in the spaces created by the corners 70*a* and 70*b* and the groove 72 similarly as for portions 66*a*, 66*b* of FIG. 7**.

It will now be appreciated that the present invention provides a convenient, compact and efficient method of protectively storing both prints and negatives, and of assembling and displaying the prints 5 quickly and easily on the pads 40, as described earlier. The package 1, therefore, acts as an album to protect and display the prints and as a storage means to store the respective negatives with the prints. Hence, the user may omit placing the prints 5 in a separate photo album and having to store the negatives separate therefrom. Stiff cardboard boxes (not shown) adapted to neatly store several of the photo display packages 1 together may also be provided to form mini-photo libraries.

The present invention provides further advantages to photo processing outlets in that sheets of promotional materials, (indicated in ghost outline by reference numeral 68 in FIG. 2), may be attached to the spine 22. For example, the sheets 68 may be in the form of a series of coupons with perforations therebetween so that each can be individually torn out by the user and others. This provides an advantage over prior art methods where coupons are loosely provided in a photo package and are easily thrown out or lost, and where ads or promotions are permanently printed on the packaging itself. Further examples of promotional materials include a monthly calendar, a note pad, a map, an instruction sheet, etc.

Although the present invention has been described with reference to preferred embodiments thereof, it will be apparent to those skilled in the art that various alterations and modifications may be carried out without departing from the scope of the invention. For example, the package 1 may be adapted for holding and displaying baseball cards or business cards. Where the package 1 is used at professional baseball games to hold and display ticket stubs, for instance, the sheets 68 may comprise score sheets for use by fans during the baseball game.

I claim:

1. A package for photo prints and film comprising a cover with an inside face, said cover having:

(i) a top edge;

(ii) a bottom edge;

(iii) first and second side edges;

(iv) a center spine extending between said top and bottom edge of said cover and dividing said inside face into first and second portions, said cover being foldable about said spine between an open configuration where said first and second portions are splayed apart and a closed configuration where said first and second portions are brought into a facing, overlying relationship;

(v) first and second pockets overlying said first and second inside face portions, respectively, for storing said prints and film; and (vi) a means for assembling said prints in an overlapping, staggered relationship and for displaying same when said cover is in the open configuration comprising at least one generally rectangular pad having: a generally flexible substrate; an adhesive coating a first side of said substrate; and a plurality of removable ribbons covering said adhesive to protect same;

wherein said ribbons are removable from the substrate to uncover at least some of said adhesive for attaching said print to said cover by pressing an edge of said print against said uncovered adhesive.

2. The package of claim 1 wherein said ribbons comprise flexible sheeting.

3. The package of claim 2 each of said ribbons is of uniform width throughout its length.

4. The package of claim 3 wherein the opposite longitudinal edges of said ribbons abut with the longitudinal edges of adjacent ribbons.

5. The package of claim 4 wherein said rectangular pad has a top end, a bottom end and first and second side edges and said ribbons extend across the pad between its first and second side edges and parallel to its top and bottom ends, said top end of said pad being connected adjacent the top edge of one of said first and second inside face portions, and wherein the ribbon closest to the top edge of said pad is wider than the other of said ribbons to facilitate mounting of a first print.

6. The package of claim 4 wherein said top edge ribbon is 0.25 inches wide and the other of said ribbons are each 0.125 inches wide.

7. The package of claim 6 wherein said pad has 12 to 14 ribbons thereon.

8. The package of claim 6 wherein said pad has 24 to 28 inches thereon.

9. The package of claim 6 wherein said pad has up to 36 ribbons thereon.

10. The package of claim 1 wherein each ribbon has a tab which does not contact said adhesive and can be grasped by the user to facilitate pulling the ribbon off the coated substrate.

11. The package of claim 10 wherein said tab comprises an end portion of said ribbon extending beyond a side edge of said substrate.

12. The package of claim 10 wherein said tab comprises an end portion of said ribbon located above a side edge portion of said substrate which does not have an adhesive material coating thereon.

13. The package of claim 1 wherein a flap extends away from the top edge of at least one of said first and second portions of said cover and is located between said spine and the respective side edge of said portion, said flap being adapted to be folded over onto the inside face of the first or second portions of said cover and to connect said pad adjacent said top edge.

14. The package of claim 1, further including sheet material extending from the inside face of said spine.

15. A package for storing photo prints and films and for assembling and displaying the prints, said package comprising a cover with an inside face, said cover having:

(i) a top edge;
(ii) a bottom edge;
(iii) first and second side edges;
(iv) a center spine extending between said top and bottom edge of said cover and dividing said inside face into first and second portions, said cover being foldable about said spine between an open configuration where said first and second portions are splayed apart and a closed configuration where said first and second portions are brought into a facing, spaced relationship;
(v) a pocket overlying each of said first and second inside face portions, each of said pockets adapted for storing said prints and film;
(vi) a generally rectangular pad connected along an edge thereof adjacent the top edge of one of said first and second portions for assembling said prints in an overlapping, staggered relationship and for displaying same when said cover is in the open configuration, said pad having:
  (a) a generally flexible substrate;
  (b) an adhesive coating a first side of said substrate; and
  (c) a plurality of removable ribbons covering said adhesive to protect same;

wherein one of said ribbons is pulled off the substrate to uncover a respective zone of adhesive coated substrate for attaching said print to said cover by pressing an edge of said print against said uncovered adhesive coating.

16. The package of claim 15 further including two pads, wherein one of said pads is connected to each of said first and second portions.

17. The package of claim 15 further including sheet material extending from said inside face of said spine.

18. A package for photo prints and film comprising a cover with an inside face, said cover having:

(i) a top edge;
(ii) a bottom edge;
(iii) first and second side edges;
(iv) a center spine extending between said top and bottom edge of said cover and dividing said inside face into first and second portions, said cover being foldable about said spine between an open configuration where said first and second portions are splayed apart and a closed configuration where said first and second portions are brought into a facing, overlying relationship;
(v) first and second pockets overlying said first and second inside face portions, respectively, for storing said prints and film; and
(vi) a means for assembling and displaying said prints when said cover is in the open configuration comprising a substrate having an adhesive coating a first side of said substrate for attaching said prints to said cover by pressing an edge of said prints against said adhesive.

19. The package of claim 18 wherein at least one removable ribbon covers said adhesive to protect same, said ribbon being removable from said substrate to uncover at least some of said adhesive to attach at least one of said prints thereto.

20. A method of packaging photo prints and films comprising the steps of:

(i) providing a package having:
  (a) a cover with first and second pockets; and
  (b) a means for assembling and displaying said prints when said cover is in an open configuration comprising a substrate having an adhesive coating a first side of said substrate;
(ii) placing said prints and film in said first and second pockets; and
(iii) attaching said prints to said cover by pressing an edge on said print against said adhesive;

wherein said prints and films are stored adjacent one another and said prints are assembled for display.

21. The method of claim 20 wherein the step of providing a package further comprises providing a plurality of removable ribbons covering said adhesive to protect same; and said step of attaching said prints further comprises the step of pulling one of said ribbons off the substrate to uncover a respective zone of adhesive coated substrate to receive said print.

22. The method of claim 21 wherein the step of attaching said prints further comprises:

(i) pulling off a first ribbon located at one end of said substrate;
(ii) mounting a first print onto the adhesive coated substrate so uncovered;
(iii) folding said first print over to expose said ribbons remaining on the substrate;
(iv) removing a second ribbon located adjacent said first ribbon; and repeating the foregoing steps until such prints are attached as may be desired.

* * * * *